US007179103B2

(12) United States Patent
Ting

(10) Patent No.: US 7,179,103 B2
(45) Date of Patent: Feb. 20, 2007

(54) CARD CONNECTOR

(75) Inventor: Chien Jen Ting, Tu-Cheng (TW)

(73) Assignee: Hon Hai Precision Ind. Co., Ltd., Taipei Hsien (TW)

( * ) Notice: Subject to any disclaimer, the term of this patent is extended or adjusted under 35 U.S.C. 154(b) by 0 days.

(21) Appl. No.: 11/348,872

(22) Filed: Feb. 6, 2006

(65) Prior Publication Data

US 2006/0178045 A1 Aug. 10, 2006

(30) Foreign Application Priority Data

Feb. 4, 2005 (TW) ..... 94202261 U

(51) Int. Cl.
*H01R 13/62* (2006.01)

(52) U.S. Cl. ..... 439/159; 439/540.1

(58) Field of Classification Search ..... 439/159, 439/540.1

See application file for complete search history.

(56) References Cited

U.S. PATENT DOCUMENTS 5,738,532 A * 4/1998 Takano et al. ..... 439/79
6,095,827 A * 8/2000 Dutkowsky et al. ..... 439/83
6,095,830 A * 8/2000 Hirata et al. ..... 439/101
6,238,240 B1 5/2001 Yu

* cited by examiner

*Primary Examiner*—Truc Nguyen
(74) *Attorney, Agent, or Firm*—Wei Te Chung

(57) ABSTRACT

A card connector includes an insulating housing (3) and a number of contacts (2) received in the insulating housing (3). The insulating housing (3) comprises a base (10) and a pair of guiding arms (13) extending from opposite lateral sides of the base (10) along a card ejecting direction and defining a card receiving space with soldering portions extending forwardly and backwardly respectively. The insulating housing (3) is formed with a pair of mating portions (11, 12) in which the contacts (2) are received, The mating portions extend from the base (10) along the card ejecting direction to expose into the card receiving space at a position of upper and lower sides.

10 Claims, 8 Drawing Sheets

CARD CONNECTOR

BACKGROUND OF THE INVENTION

1. Field of the Invention

The present invention is generally related to a card connector, and especially to a stacked card connector.

2. Description of Related Art

At present, electrical cards are widely used in electrical appliances to accomplish signal transmission or signal storage function. Certainly, card connectors are indispensable for receiving the corresponding electrical cards. With requirements of larger capacity of the electrical appliances, on the one hand, enlarging capacity of the electrical cards themselves; on the other hand, adding quantities of the card connectors in the electrical appliances to receive more electrical cards. Thus, a stacked card connector arises.

U.S. Pat. No. 6,238,240 discloses a stacked card connector. The stacked card connector comprises a first card connector, a second card connector, each connector includes a row of upper terminals and a row of lower terminals. A spacer defines passageways for accommodating the mounting portions of the terminals. The spacer is inserted into a connector mounted on a mother board.

However, elements of the stacked card connector are excessive so that increasing manufacturing and assembling cost.

Hence, an improved card connector is highly desired to overcome the aforementioned disadvantages of the prior art.

SUMMARY OF THE INVENTION

Accordingly, an object of the present invention is to provide a card connector which has secure and simple structures.

To achieve the above object, a card connector comprises an insulating housing and a plurality of contacts received in the insulating housing. The insulating housing comprises a base and a pair of guiding arms extending from opposite lateral sides of the base along a card ejecting direction and defining a card receiving space. The insulating housing is formed with a pair of mating portions, the contacts are received in the mating portions, and the mating portions extend from the base along the card ejecting direction to expose into the card receiving space at a position of upper and lower sides. Contacts arranged in upper line each comprising a contacting portion extending into the upper mating portion, a tail portion extending behind the housing, Contacts arranged in lower line each comprising a contacting portion extending into the lower mating portion, a tail portion extending forwardly.

Other objects, advantages and novel features of the present invention will be drawn from the following detailed description of a preferred embodiment of the present invention with attached drawings.

DETAILED DESCRIPTION OF THE INVENTION

Reference will now be made in detail to the preferred embodiment of the present invention.

Figure 1:
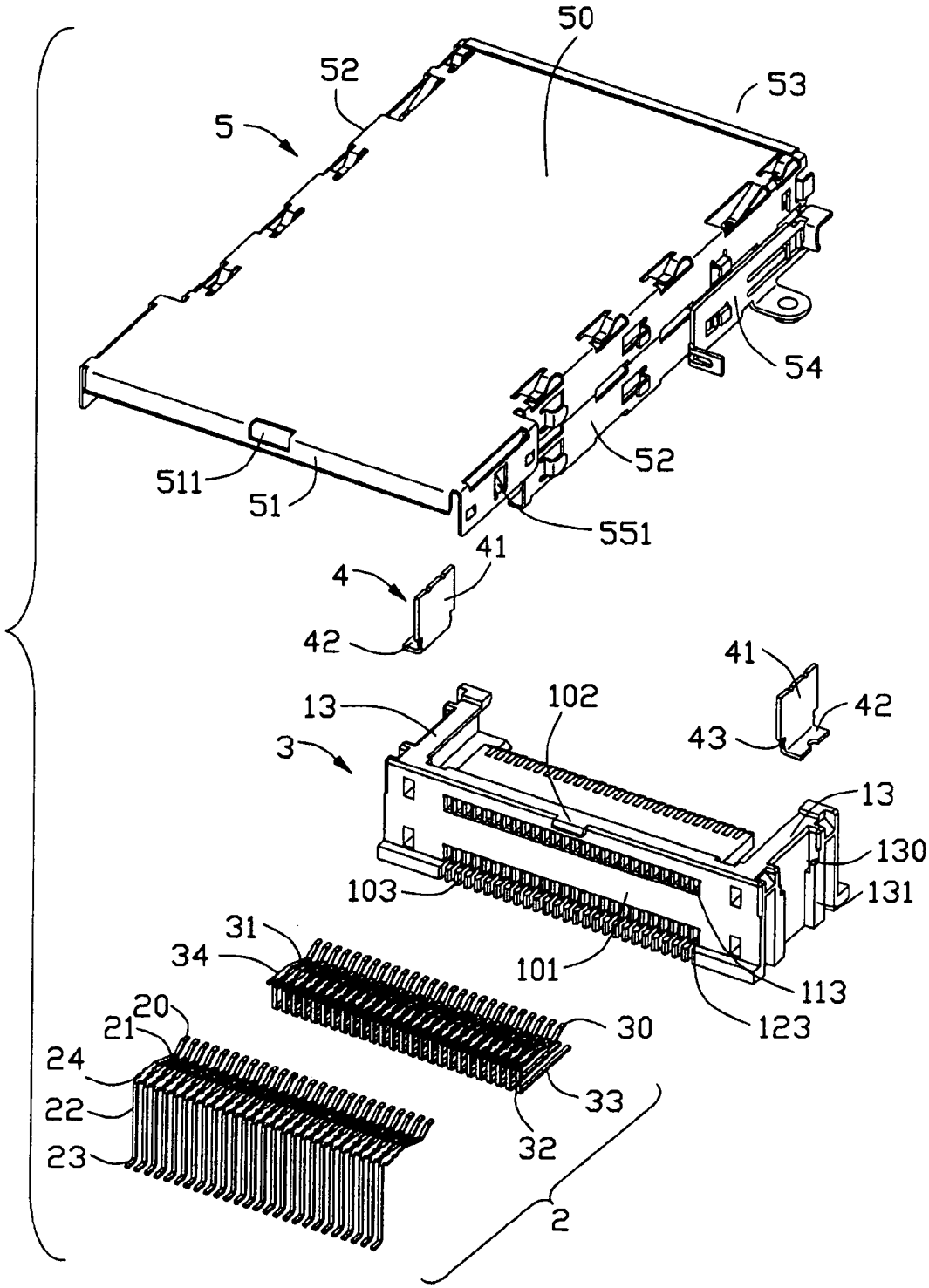
FIG. 1 is an exploded, perspective view of the card connector in accordance with the present invention.
Figure 2:
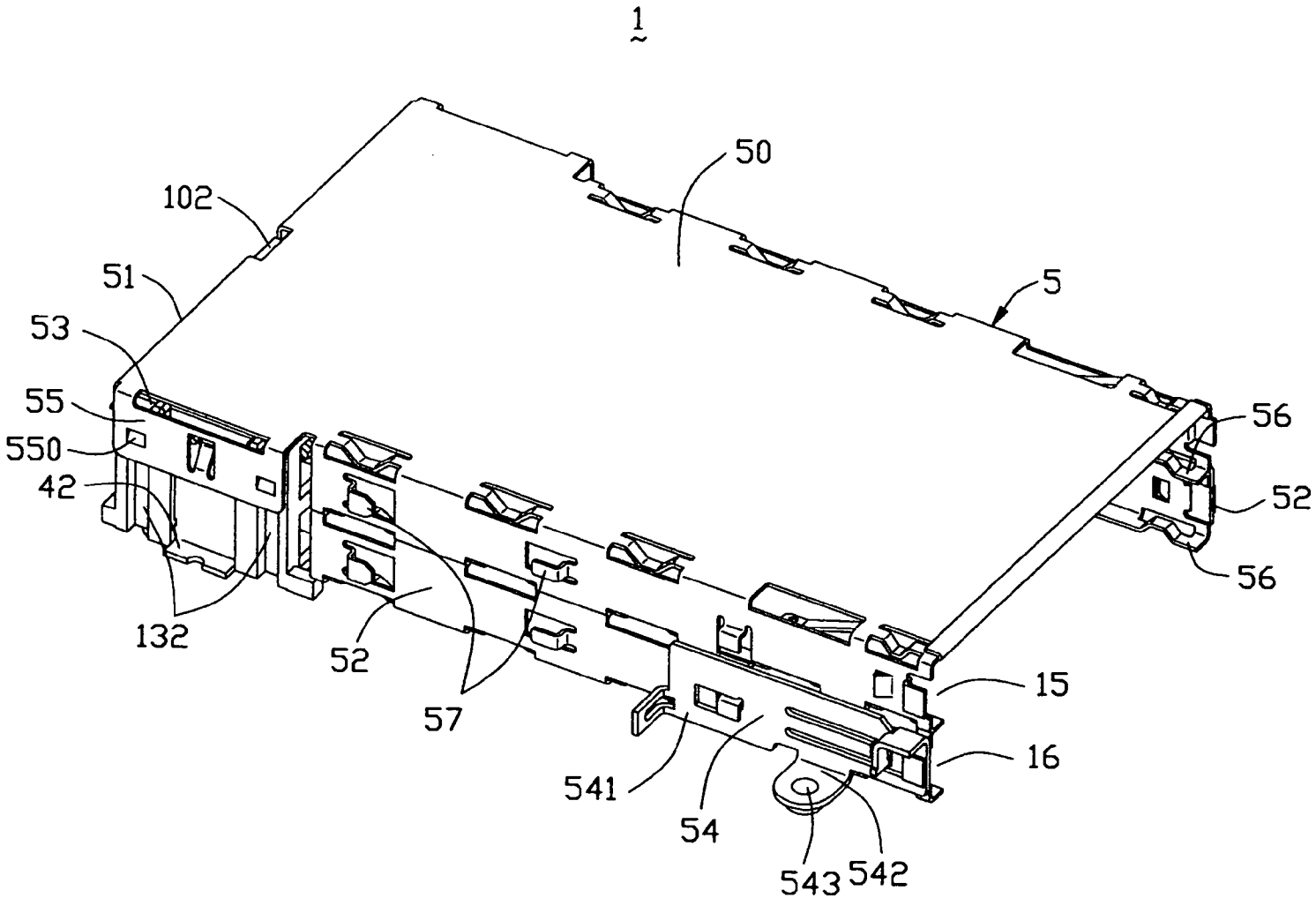
FIG. 2 is an assembled perspective view of the card connector of FIG. 1, but from another aspect.
Figure 3:
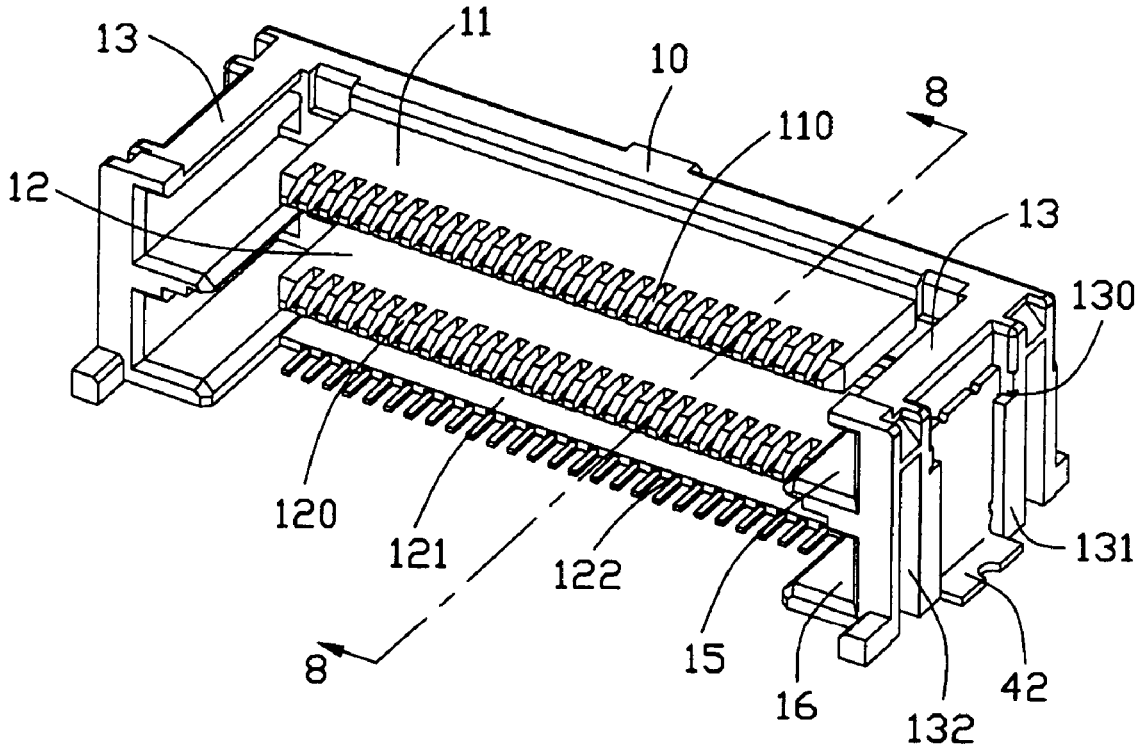
FIG. 3 is a perspective view of the insulating housing of the card connector of FIG. 1, but from another aspect.
Figure 4:
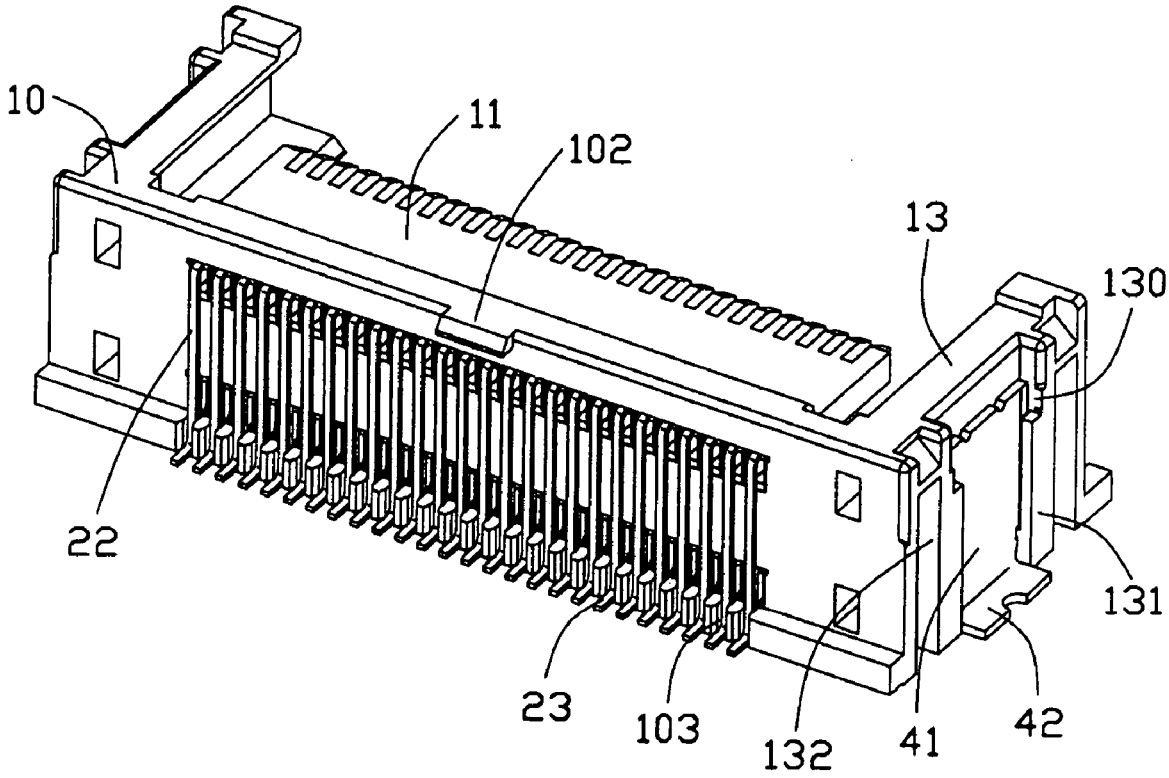
FIG. 4 is assembled perspective view of the card connector of FIG. 1, but the shell not show.

Referring to FIGS. 1–3, the card connector in accordance with the present invention is adapted for receiving two electrical cards. The card connector comprises an elongated insulating housing 3, a plurality of contacts 2 received in the insulating housing 3, a pair of grounding pieces 4, a shell 5 covering the insulating housing 3 and a pair of standoff devices 54.

The elongated insulating housing 3 comprises a base 10, a pair of guiding arms 13 extending forward from opposite lateral sides of the base 10 and a pair of tongue-type mating portions 11, 12 extending forwardly from the base 10 and locate between the guiding arms 13. A card receiving space (not labeled) is defined among the base 10 and the guiding arms 13. The mating portions 11, 12 are exposed in the card receiving space and arranged in an upper and lower position and spaced from each other. Each mating portion 11, 12 defines a plurality of receiving channels 110, 120 respectively for receiving the contacts 2. The base 10 defines a plurality of passages 113, 123 each communicating with the corresponding receiving channels 110, 120 and running through the base 10. A plurality of slots 103 is defined in a lower side of a rear face of the base 10, a plurality of passages 122 is formed on a bottom plate 121 of the housing each communicating with a corresponding slot 103, and a locking portion 102 protrudes backwardly from a middle portion of an upper side of the rear face of the base 10. Each passage 113 is formed in one upright plane with one corresponding passage 123 and a slot 103 respectively.

Figure 5:
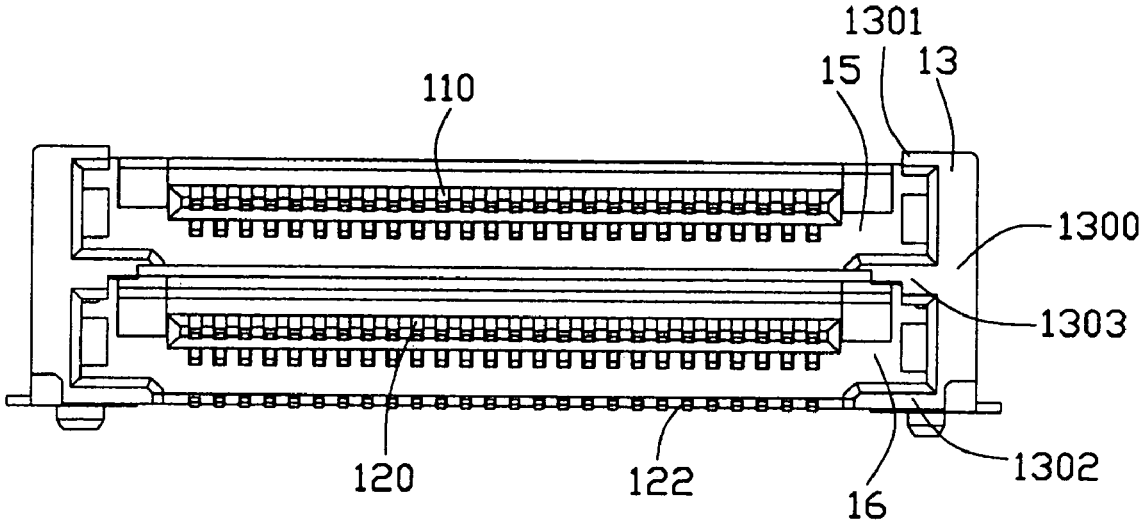
FIG. 5 is a front plane view of the insulating housing of the card connector of FIG. 1.
Figure 6:
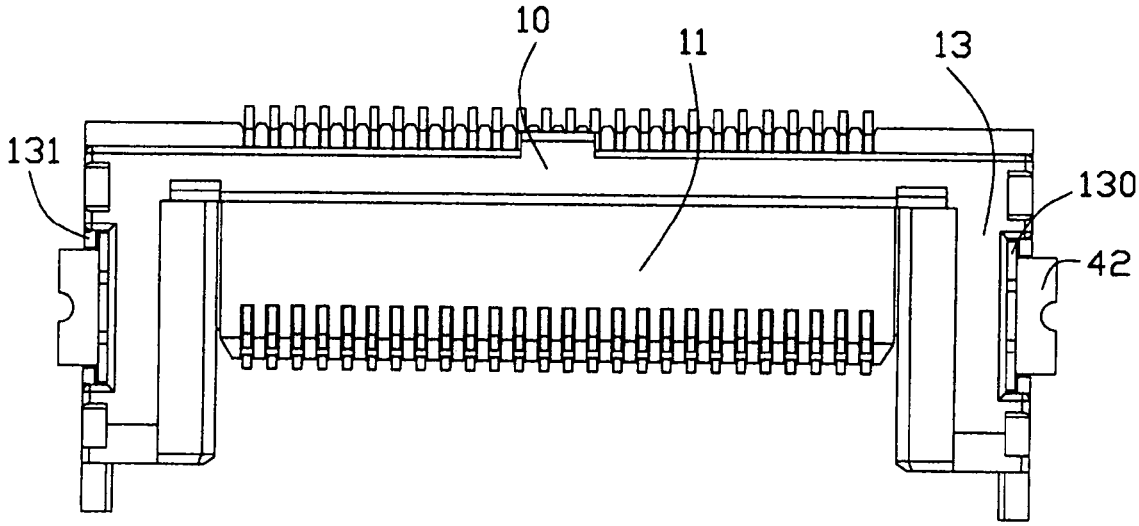
FIG. 6 is a top plane view of the insulating housing of the card connector of FIG. 1.
Figure 7:
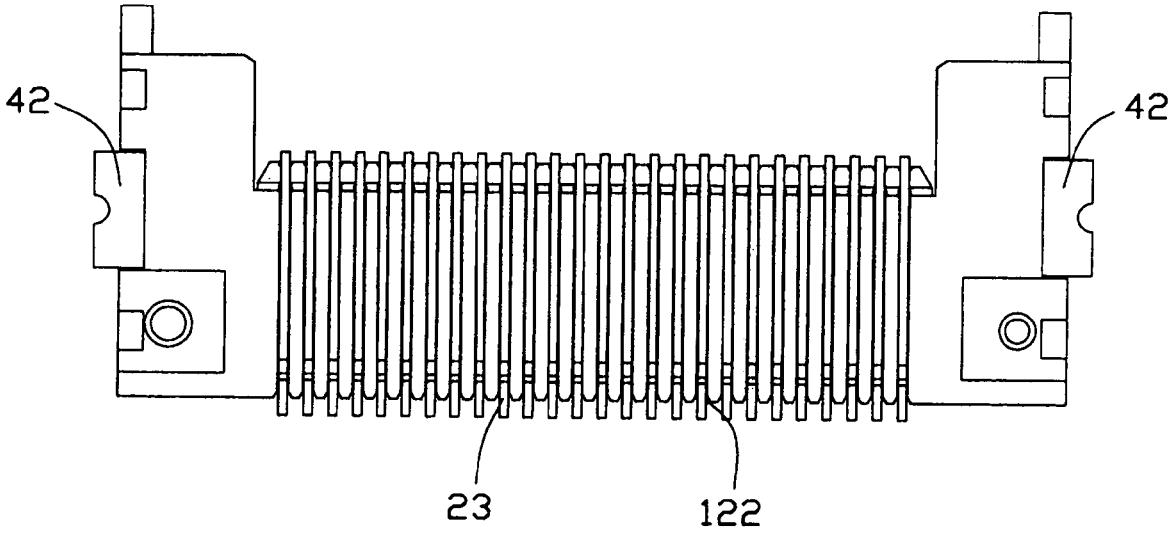
FIG. 7 is a bottom plane view of the insulating housing of the card connector of FIG. 1.

Referring to FIGS. 1, 3 and 5, Each guiding arm 13 comprises an upright portion 1300, an upper and a lower portions 1301, 1302 extending horizontally face to face from opposite upper and lower sides of the upright portion 1300 and an intermediate portion 1303 locating between the adjacent mating portions to divide the card receiving space into an upper space 15 and a lower space 16 communicating with the upper space. The mating portions 11, 12 are exposed in the upper and lower spaces, respectively. A pair of receiving slots 130 is each formed on outside walls 131 of guiding arms 13 respectively. Recesses 132 recessed inwardly from the outside wall 131 of the guiding arms 13 are defined besides the receiving slots 130.

Figure 8:
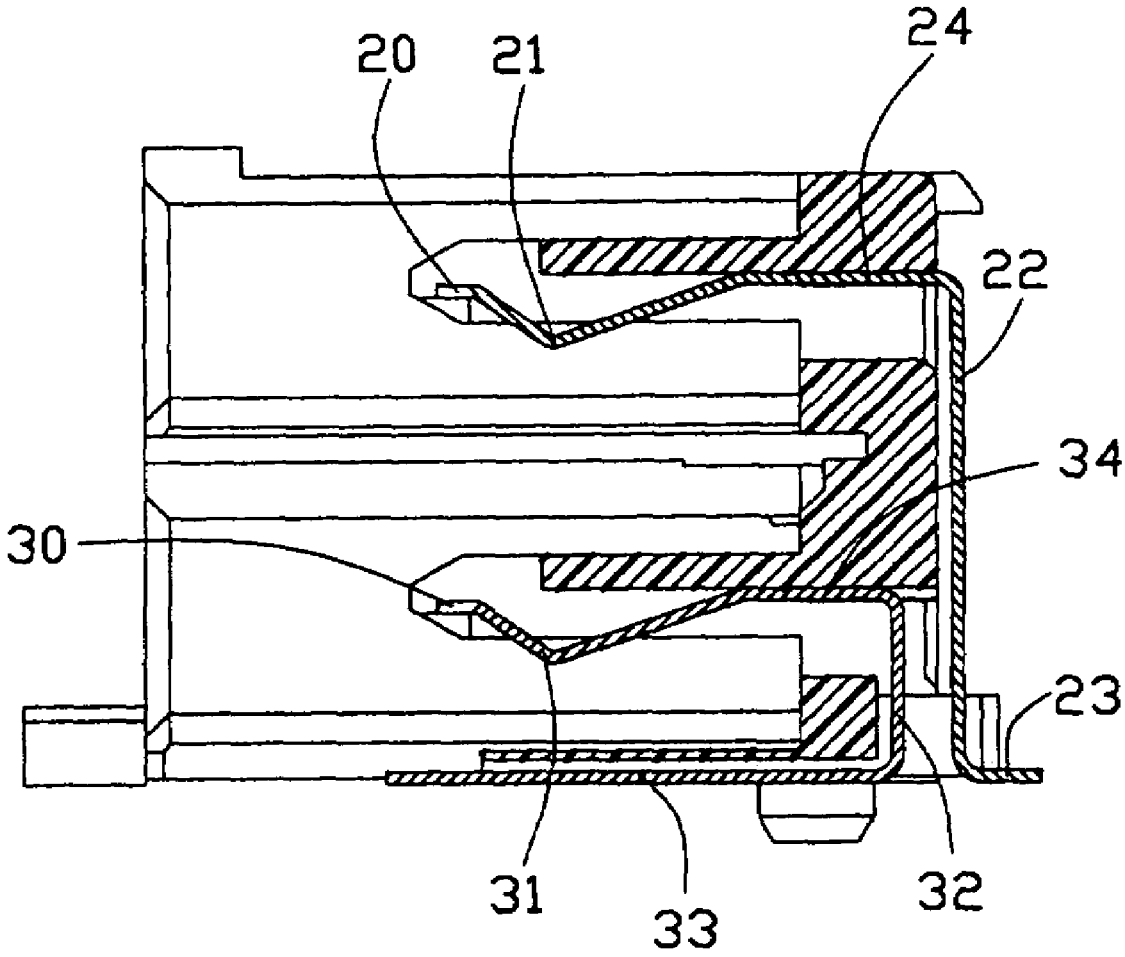
FIG. 8 is a section view of the insulating housing of the card connector taken along the line 8—8 of FIG. 3.

Referring to FIGS. 1, 3 and 8, the contacts 2 are grouped with upper contacts and lower contacts corresponding to the mating portions 11, 12. Each upper and lower contact respectively comprises end portions 20 and 30, contacting portions 21 and 31 extending backwardly from the end portions 20 and 30 respectively, holding portions 24 and 34 extending backwardly from the contacting portion 21 and 31 respectively, connecting portions 22 and 32 extending downwardly from the holding portions 24 and 34, and a soldering portion 23 bent perpendicular to the connecting portion 22 to extending backwardly from the connecting portion 22 for soldering on a printed circuit board (not shown), and a soldering portion 33 bent perpendicular to the connecting portion 32 to extending forwardly from the connecting portion 32 for soldering on a printed circuit board (not shown). Each contact 2 is assembled forwardly from a rear face the housing 3, the end portions 20 and 30 are held in the receiving channels 110, 120 respectively, and the contacting portions 21, 31 moveably protrudes out of the channels 110, 120 respectively, and the holding portions 24, 34 are interferentially secured in the passages 113, 123 of the insulating housing 3 respectively. And the connecting portions 24, 34 of the upper and lower contacts 20 are arranged in the slots 103 of the insulating housing 3. And each pair of connecting portions 24, 34 are received in a same slot 103. The soldering portion 23 extending behind the housing, and the soldering portion 33 extending forwardly and receiving in the passages 122 formed on bottom of the housing.

The grounding pieces 4 are approximately L-shaped. Each grounding piece 4 comprises an upright body 41 interferentially received in the receiving slot 130 and a horizontal body 42 extending from the upright body 41 for soldering on a printed circuit board (not shown).

Referring to FIGS. 1 and 2, the shell 5 is stamped from a metal sheet. The shell 5 comprises a front part (not labeled) and a rear part (not labeled) extending from the front part. The shell 5 covers the insulating housing 3 and comprises a main body 50, a flange 51 bended downwardly from a rear end of the main body 50 and a pair of sidewalls 55 extending downwardly from opposite lateral sides of the rear part of the main body. A cutout 511 is defined in the flange 51 to mate with the locking portion 102 of the insulating housing 3. Each sidewall 55 defines a pair of locking pieces 550 for securing in the recesses of the housing 3 and a resilient piece 551 located between the pair of locking pieces 550 to electrically abut against the grounding piece 4. Thus, the rear part of the shell 5 securely covers the insulating housing 3.

The front part of the shell 5 is approximately a frame configuration, defining a cavity (not labeled) with an entrance opening at a front end thereof to communicate with the card receiving space of the housing 3. The front part of the shell 5 comprises a front part of main body and a pair of guiding arms 52 extending downwardly from opposite lateral sides of the main body 50. Each guiding arm 52 is formed with a first and a second guiding portion 56, protruding horizontally into the cavity from a free end and approximately a midsection of the guiding arm 52, respectively. Thus, dividing the cavity into guiding passages 15, 16 communicating with the corresponding upper and lower spaces of the insulating housing 3, respectively. In addition, the shell 5 is formed with a slot 53 and clasps 57 for mounting an ejector (not shown) thereon.

Referring to FIG. 2, each standoff device 54 is disposed on the front part of the shell 5 adjacent to the entrance opening. The standoff device 54 comprises a locking body 541 locking on the shell 5 and a holding body 542 extending perpendicularly to the locking body 541 to mount on the printed circuit board (not shown). A bolt hole 543 is defined in the holding body 542.

In this invention, each pair of contacts 2 received in different mating portions 11, 12 is assembled from a rear face of housing and received on one slot, thus provide a card connector which has secure and simple structures, and is assembled easily.

While a preferred embodiment in accordance with the present invention has been shown and described, equivalent modifications and changes known to persons skilled in the art according to the spirit of the present invention are considered within the scope of the present invention as described in the appended claims.

What is claimed is:

1. A card connector adapted for receiving electrical cards, comprising:

an insulating housing comprising a base and a pair of guiding arms extending from opposite lateral sides of the base along a card ejecting direction and defining a card receiving space;

a plurality of contacts arranged in upper and lower line each retained on the housing from a rear face to electrically connect with the corresponding electrical card; and the insulating housing formed with an upper and a lower tongue-type mating portions each for receiving contacts, the mating portions extending from the base along the card ejecting direction to expose into the card receiving space, each guiding arm formed with one or more intermediate portions between the mating portions to sustain the electrical card to electrically connect with the corresponding mating portion;

the contacts arranged in upper line each comprising a contacting portion extending into the upper mating portion, a holding portion interferentially secured in the housing, and a tail portion extending behind the housing;

the contacts arranged in lower line each comprising a contacting portion extending into the lower mating portion, a holding portion interferentially secured in the housing, and a tail portion extending forwardly on a bottom of the housing;

wherein each contact further has an end portion formed in the front of the contacting portion being hold in the tongue-type mating portion, the contacting portion movably protruded out of the tongue-type mating portion to electrically connect with the corresponding electrical card.

2. The card connector as described in claim 1, wherein the guiding arm comprises an upright portion, an upper portion and a lower portion, and wherein the upper and lower portion extend face to face from opposite upper and lower sides of the upright portions, and the intermediate portions positioned between to upper and lower portions.

3. The card connector as described in claim 1, wherein each contact further having a connecting portion between the holding portion and solder portion, each pair of the connecting portions being received in a slot formed on the housing.

4. The card connector as described in claim 1, further comprising a shell covering the insulating housing.

5. The card connector as described in claim 3, wherein the soldering portions of the upper and lower contact line extending to different side of the housing.

6. The card connector as described in claim 5, wherein to soldering portions of the lower contact line extending forwardly and received in passages formed on the bottom of the housing.

7. The card connector as described in claim 4, wherein the shell comprises a rear part covering the insulating housing and a front part extending from the rear part.

8. The card connector as described in claim 7, wherein the front part of the shell is approximately a frame configuration and defining a cavity communicating with the card receiving space of the insulating housing to receive the electrical cards.

9. The card connector as described in claim 4, wherein the shell is formed with a slot and clasps to secure an ejector thereon.

10. The card connector as described in claim 4, further comprising a pair of grounding pieces disposed on the insulating housing to electrically connect with the shell.

* * * * *